US005150673A

United States Patent [19]

Hoshiba et al.

[11] Patent Number: 5,150,673

[45] Date of Patent: Sep. 29, 1992

[54] FUEL SUPPLYING DEVICE FOR MARINE PROPULSION ENGINE

[75] Inventors: Akihiro Hoshiba; Masaki Okazaki; Junichi Hasegawa, all of Hamamatsu, Japan

[73] Assignee: Sanshin Kogyo Kabushiki Kaisha, Hamamatsu, Japan

[21] Appl. No.: 685,129

[22] Filed: Apr. 12, 1991

[30] Foreign Application Priority Data

Apr. 13, 1990 [JP] Japan ..... 2-98396

[51] Int. Cl.[5] ..... F02M 1/08

[52] U.S. Cl. ..... 123/179.15; 123/179.18; 123/438

[58] Field of Search ..... 123/179 G, 180 R, 180 T, 123/581, 437, 438

[56] References Cited

U.S. PATENT DOCUMENTS 3,706,444 12/1972 Masaki et al. ..... 123/179 G
4,480,618 11/1984 Kamifuji et al. ..... 123/179 G
4,519,367 5/1985 Nomura ..... 123/179 G

FOREIGN PATENT DOCUMENTS 2-16348 1/1990 Japan .
2-30967 2/1990 Japan .

*Primary Examiner*—Andrew M. Dolinar
*Attorney, Agent, or Firm*—Ernest A. Beutler

[57] ABSTRACT

An outboard motor having a charge forming system including an enrichment fuel device that supplies additional fuel and air to the engine for starting and warm up. The fuel and air are supplied from one charge former of the engine and are delivered to a balance passage of a spacer between the charge formers and the intake manifold. The additional air supplied by the enrichment device is drawn from an air circuit of the carburetor so as to reduce the discharge pressure of the fuel discharge circuits of the carburetor to draw additional enrichment fuel from those discharge circuits when the enrichment device is in operation.

20 Claims, 4 Drawing Sheets

FUEL SUPPLYING DEVICE FOR MARINE PROPULSION ENGINE

BACKGROUND OF THE INVENTION

This invention relates to a fuel supplying device for a marine propulsion engine and more particularly to an improved arrangement for enriching the fuel supply to an engine under certain running conditions.

It is well known in the charge forming systems for internal combustion engines to provide supplemental fuel supply for accommodating certain running conditions. Such supplemental systems are frequently employed in connection with charge forming systems employing carburetors. The reason for this is that the normal charge forming system may not be able to accommodate all of the various fuel/air supply requirements for an engine as are encountered during its running and operation. For example, it is usually desirable or necessary to provide supplemental fuel for starting, particularly at low temperatures and also for warm up operation under low temperature conditions.

One highly effective form of supplemental fuel supply draws fuel from the fuel bowl of a carburetor, for example, one carburetor of a multiple carbureted engine, and supplies this supplemental fuel to a number of cylinders through a spacer positioned between the carburetors and the intake manifold. With such systems, it is also desireable to provide supplemental air for running under these conditions to insure better combustion.

This supplemental air may either be drawn from an atmospheric source directly or from the area over the fuel in the fuel bowl of the carburetor from which the fuel is drawn. If the latter arrangement is employed, certain problems result. That is, if supplemental air is drawn from the area above the fuel in the fuel bowl, then a reduced air pressure acting on the fuel in this fuel bowl will cause a decrease in fuel supply through the main circuits of the carburetor such as the idle or main discharge circuit. As a result, the amount of supplemental fuel introduced to the spacer may increase but the total fuel supplied might either stay the same or be decreased. These problems are particularly acute when operating an idle due to the low suction which exist at the idle discharge ports and the flow restriction in them. In addition, when the system is utilized with an outboard motor which may be tilted to various running conditions, the combination of the reduced suction and the trim angle can serious deplete the fuel supply and cause uneven running or even stalling under extreme conditions.

It is, therefore, a principal object to this invention to provide an improved fuel supplying device for a marine propulsion engine.

It is a further object to this invention to provide a fuel supplying device for a marine propulsion engine wherein both air and fuel are supplied and the supplemental supply is operated in such a way so as to increase the amount of fuel supplied by the main fuel supply system as well.

SUMMARY OF THE INVENTION

This invention is adapted to be embodied in an enrichment device for providing additional fuel to an engine for accommodating a certain condition. The engine comprises a charge former have a fuel bowl for containing a head of fuel, a discharge circuit comprised of a fuel conduit connecting the fuel bowl with a discharge port in an induction passage of the charge former and an air conduit communicating a source of atmospheric air with the fuel conduit for mixture with the fuel delivered through the discharge port. The enrichment device comprises means for delivering fuel and air to the engine in additional to that supplied by the charge former under the certain condition. The additional air supplied to the engine by the enrichment device draws air from the air conduit for reducing the pressure in the fuel conduit of the charge former for further increasing the fuel delivered to the engine in response to the certain condition.

BRIEF DESCRIPTION OF THE INVENTION

DETAILED DESCRIPTION OF THE PREFERRED EMBODIMENT OF THE INVENTION

Figure 1:
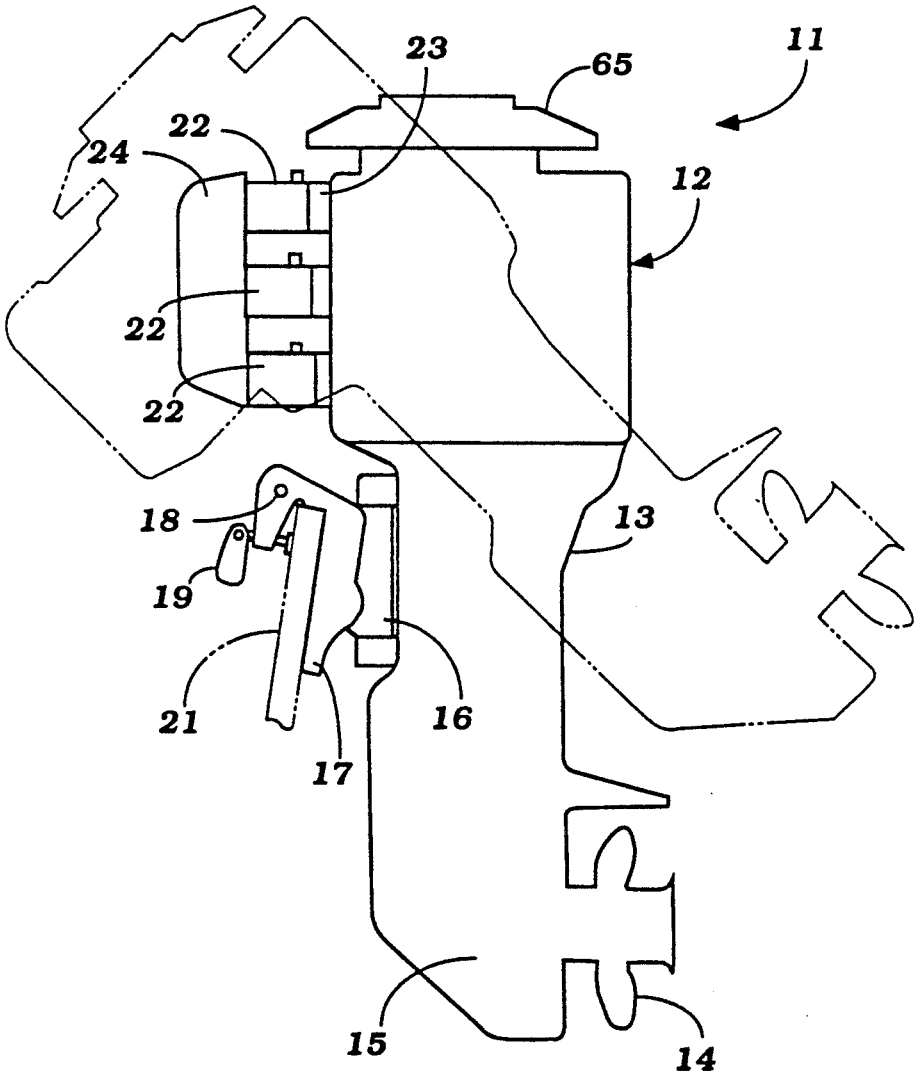
FIG. 1 is a side elevation view of an outboard motor having a fuel supply and enrichment system constructed in accordance with an embodiment of the invention.

Referring first to FIG. 1, an outboard motor having a fuel supply and enrichment system constructed in accordance with an embodiment of the invention is identified generally by the reference numeral 11. Although the invention has utility in connection with other applications for internal combustion engines than outboard motors, it has particular utility in such applications due to the fact that outboard motors have their trim position adjusted and this can effect the fuel supply to the engine. Except, in so far as the fuel supply and enrichment system is concerned, the outboard motor 11 may be considered to conventional and, for that reason, the details of the construction of the outboard motor are not believed to be necessary to understand the construction and operation of the invention.

Outboard motor 11 is comprised of a power head consisting of an internal combustion engine 12 and a surrounding protective cowling, which is deleted from FIG. 1 so as to more clearly show the outline of the engine 12. In the illustrated embodiment, the engine 12 is comprised of a three cylinder inline crankcase compression internal combustion engine. It should be readily apparent, however, to those skilled in the art how the invention can be employed to engines having other cylinder numbers or other cylinder configurations as well as engines operating on other principals than the two stroke principal and engines other than reciprocating engines.

The engine 12, as is typical with outboard motor practice, is supported with its output shaft (not shown) rotating about a vertically extending axis and driving a drive shaft (also not shown) that is rotatably journaled in a drive shaft housing 13 for driving a propeller 14 mounted in a lower unit 15.

A steering shaft (not shown) is affixed to the drive shaft housing 13 is a known manner and is journaled within a swivel bracket 16 for steering of the outboard motor 11 about a generally vertically extending steering axis. The swivel bracket 16 is, in turn, pivotally connected to a clamping bracket 17 by a pivot pin 18 for tilt and trim movement of the outboard motor 11 about a generally horizontally extending axis. The solid line view of FIG. 1 shows the outboard motor 11 in a tilted down normal running condition while the phantom line view shows the outboard motor 11 in a tilted up out of the water condition.

The clamping bracket 17 carries a clamping device 19 for attachment of the outboard motor 11 to a transom 21 of an associated watercraft.

The outboard motor 11 and specifically the engine 12 is provided with a charge forming system that comprises, in the illustrated embodiment, three vertically positioned carburetors 22, each of which delivers a fuel/air charge to individual sealed crankcase chambers of the engine 12 through an intake manifold via an interpose spacer assembly 23. The carburetors 22 draw an air charge from an air inlet device 24.

Figure 2:
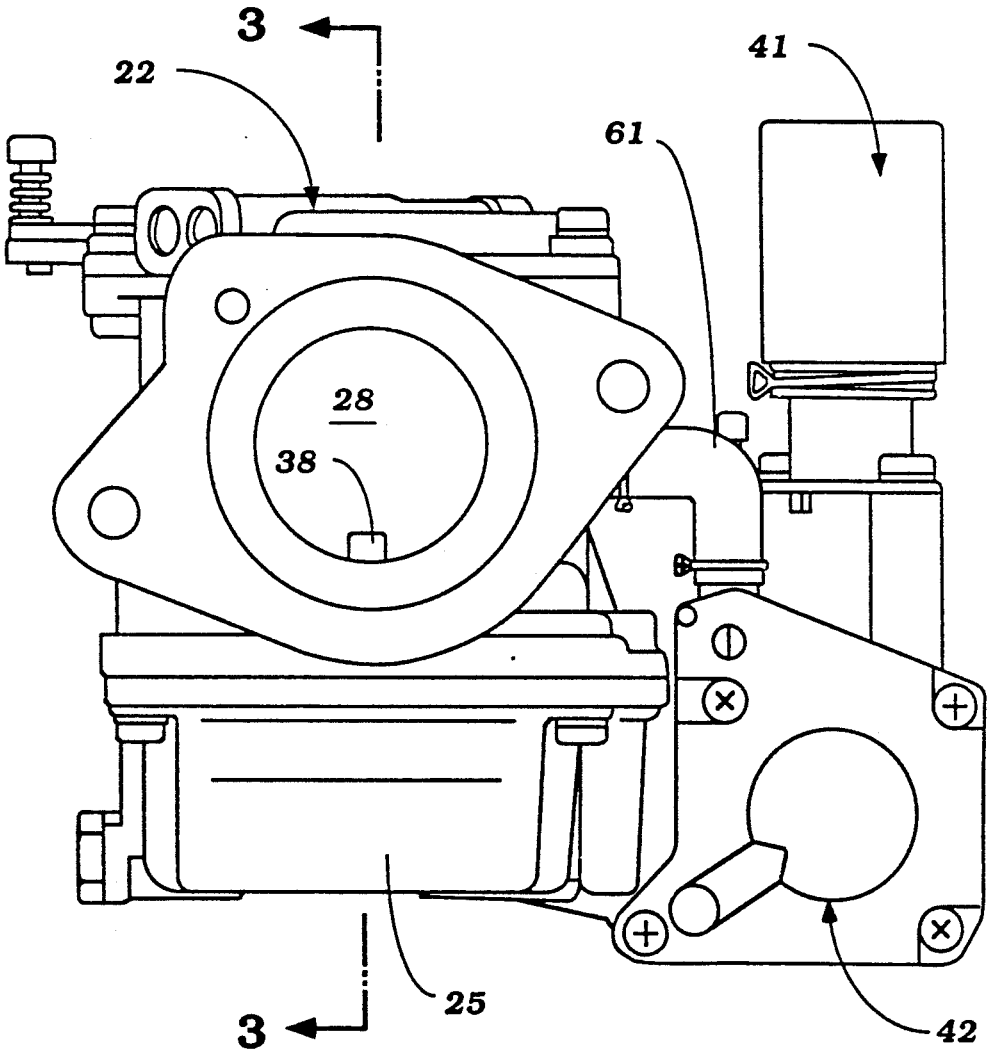
FIG. 2 is an enlarged side elevation view showing the charge former from its inlet end.
Figure 3:
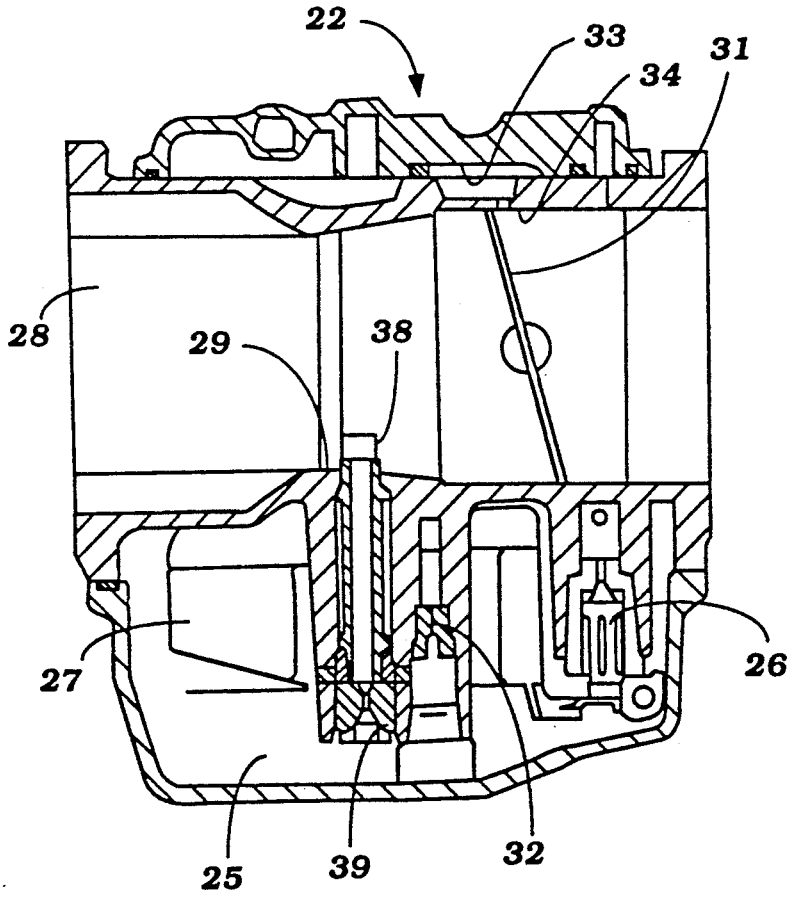
FIG. 3 is a transverse cross sectional view taken along the line 3—3 of FIG. 2.
Figure 4:
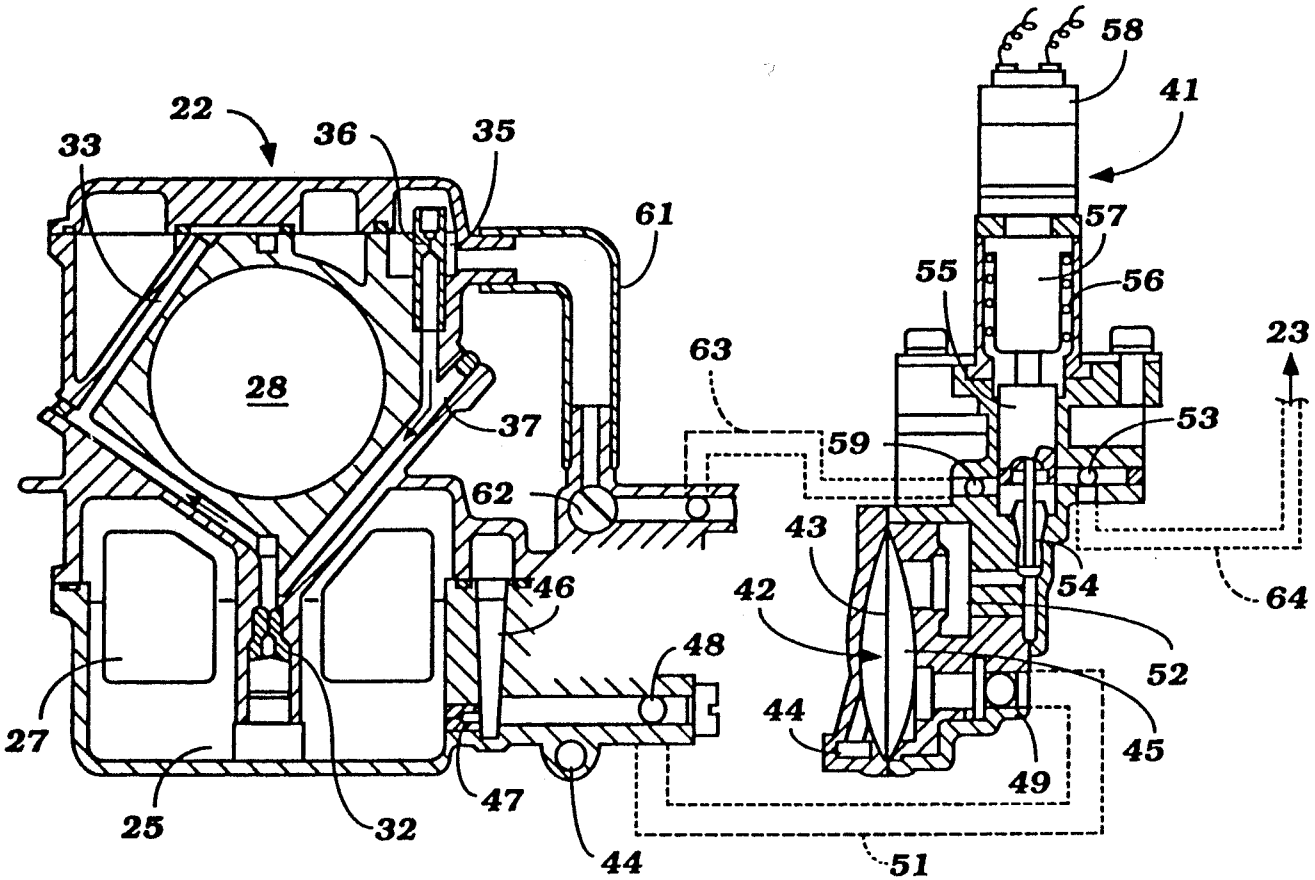
FIG. 4 is a cross sectional view taken through the charge former along a plane parallel to the plane of FIG. 2 and shows the interrelationship with the associated engine in a schematic form.

Referring now in detail to FIGS. 2 through 4, the construction of one of the carburetors 22 is illustrated and will now be described. The carburetor 22 includes a body portion from which depends a fuel bowl 25 that contains a head of fuel that is maintained at a relatively constant level by a needle valve 26 that is operated by a float 27 in a known manner.

The body portion of the carburetor 22 defines an induction passage 28 having a restricted throat 29 and in which a throttle valve 31 is positioned downstream of the throat or venturi section 29. The carburetor 22 is provided with both an idle and main fuel discharge system which draw fuel from the fuel bowl 25. The idle discharge system includes an idle jet 32 that draws fuel from the fuel bowl 25 and delivers it through an internal passage 33 formed in the body of the carburetor 22 to a idle discharge port 34 positioned downstream of the closed or idle position of the throttle valve 31. In addition to the idle discharge port 34, the carburetor 22 may also be provided with the conventional transition and midrange ports which are also served from the idle jet 32.

Air is also mixed with the idle fuel supplied from the idle jet 32. This air is drawn from the atmosphere through a chamber 35 (FIG. 4) formed in the body of the carburetor 22 through an idle air jet 36 for delivery to the passage 33 through an air passage 37 formed in the body of the carburetor 22. As a result, a fuel/air emulsion is provided for the idle fuel air supply to the engine 12.

A main fuel discharge nozzle 38 extends into the venturi section 29 and draws fuel from the fuel bowl 25 through a main metering jet 39. Air is also mixed with the main fuel flow from the main jet 39. This air is also drawn from the air inlet 35 through an appropriate internal passage including the passage 37.

The construction of the engine 12 and the carburetor 22 as thus far described, may be considered to be conventional. For that reason, further details of the construction are not believed to be necessary to enable those skilled in the art to use the invention.

In accordance with the invention, the charge forming system for the engine is also provided with an enrichment system which includes a fuel increasing device, indicated generally by the reference numeral 41. The enrichment device 41 is attached to the body of one of the carburetors 22 and draws fuel and air from this carburetor for discharge to a balance passage formed in the spacer plate 23. This balance passage communicates at least some of the induction passages serving the individual cylinders with each other so as to provide not only an air balance between the intake passages but also a simple way of supplying fuel to multiple cylinders from one enrichment device.

The enrichment device 41 is comprised of a body portion that defines a fuel pump, indicated generally by the reference numeral 42 and which is of the diaphragm type including a diaphragm 43. One side of the diaphragm 43 is in communication with a crankcase chamber of one cylinder of the engine through a passageway 44 formed in the enrichment device 41 and the body of the carburetor 22 from which the enrichment fuel is drawn. The variations in crankcase pressure, as are present in two cycle engines, will cause the diaphragm 42 to contract and expand the volume of a pumping chamber 45.

Fuel is supplied to the pumping chamber 45 from the fuel bowl 25 of the carburetor 22 with which the enrichment device 41 is associated. This fuel supply includes a well 46 that receives fuel from the fuel bowl 25 through a metering jet 47. The well 46 with an outlet port 48 formed in the body of the carburetor 22 to supply fuel to an inlet port 49 of the pumping chamber through a conduit 51. A check valve (not shown) is positioned between the port 49 and the pumping chamber 45 so that fuel may flow only to the pumping chamber through the conduit 51.

The pumped fuel is delivered to a pump output chamber 52 through a port in which a check valve (not shown) is positioned. The pumping chamber 52 is adapted to communicate with a fuel discharge port 53 of the enrichment device 41 under the control of a control valve 54. The control valve 54 is of the needle valve type and is connected to a piston type valve 55. The valves 54 and 55 are normally urged toward their open position by a coil compression spring 56 and will be urged downwardly against the action of the spring 56 upon the expansion of a wax pellet 57 which is heated by an electrical heater 58. FIG. 4 shows the condition when operating with a warm engine and the enrichment device 41 in essence shut off.

In addition to supplying enrichment fuel, the enrichment device 41 also supplies enrichment air which is admitted through a port 59 and which can communicate with the discharge port 53 when the piston valve portion 55 is in its opened position. Unlike prior art devices, wherein air for the port 59 is drawn from either the atmosphere directly or an area above the fuel and the fuel bowl 25, the air is supplied from the chamber 35 through a conduit 61 in which an air adjusting control valve 62 is provided. This air is delivered past the control valve 62 to the port 59 through a conduit 63. Adjustment of the control valve 62 will permit fine adjustment of the amount of air discharged.

System operates in the following manner. If the engine has been shut off and is cold, the wax pellet 57 will have contracted and the spring 56 will urge the piston valve 55 and needle valve 54 to their opened positions. When the engine is then cranked for starting, the pump 42 will deliver fuel to the port 53 and the air port 59 will also supply air past the piston valve 55 so as to provide a enriched fuel/air supply through a conduit 64 to the spacer plate 23 for delivery to the appropriate cylinders of the engine. Initially fuel will be provided at a relatively rapid rate by the enrichment device 41 until the amount of enrichment fuel in the well 46 has been depleted. This will provide an additional priming supply of fuel for use during cranking. However, one the quantity of the fuel in the well 46 has been depleted, than the metering jet 47 will control the amount of enrichment fuel supplied to the engine. This additional fuel supply will also continue once the engine starts until the wax pellet 57 is heated sufficiently by the heater 58 so as to close the supply of fuel and air for enrichment purposes. The heater 58 may be switched in an appropriate manner, for example by connecting it across the ignition circuit for the engine which includes a flywheel magneto 65 (FIG. 1) that is affixed to the upper end of the engine output shaft.

In addition to supplying enrichment air and fuel to the engine through the conduit 64, the drawing of air from the chamber 35 of the carburetor 22 will reduce the pressure at the discharge end of both the idle jet 32 and the main jet 39 and thus will cause additional fuel to be drawn through these jets during engine running so as to provide even further enrichment. This is particularly important in conjunction with the idle jet 32 since the idle suction is relatively small due to the small size of the orifices. In addition, this reduces pressure will also minimize variations in fuel flow due to trim adjustment of the outboard motor 11. As a result, very good running will be accomplished and stalling precluded.

Of course, the foregoing description is that of a preferred embodiment of the invention and various changes and modifications may be made without departing from the spirit and scope of the invention, as defined by the appended claims.

We claim:

1. In an enrichment device for providing additional fuel to an engine for accommodating a certain condition, said engine comprising a charge former having a fuel bowl for containing a head of fuel, a discharge circuit comprised of a fuel conduit connecting said fuel bowl with a discharge port in an induction passage of said charge former, an air conduit continuously communicating a source of atmospheric air with said fuel conduit for mixture of air with the fuel delivered through said discharge port under all discharge conditions, said enrichment device comprising means for delivering fuel and air to said engine in addition to that supplied by said charge former under certain conditions, the improvement comprising said additional air being supplied to said engine by said enrichment device being drawn from said air conduit for reducing the pressure in said fuel conduit of said charge former for further increasing the fuel delivered to said engine in response to the certain condition.

2. In an enrichment device as set forth in claim 1 wherein the fuel supplied by the enrichment device is drawn from a fuel bowl of the charge former.

3. In an enrichment device as set forth in claim 2 wherein a single valve control has portions for controlling the supply of both enrichment fuel and enrichment air.

4. In an enrichment device as set forth in claim 3 wherein the certain condition is starting of the engine.

5. In an enrichment device as set forth in claim 4 wherein the enrichment air and fuel is supplied to the engine at a location downstream of the induction passage of the charge former.

6. In an enrichment device as set forth in claim 1 wherein the discharge circuit comprises a main fuel discharge circuit of the charge former.

7. In an enrichment device as set forth in claim 6 wherein the fuel supplied by the enrichment device is drawn from a fuel bowl of the charge former.

8. In an enrichment device as set forth in claim 7 wherein a single valve controls the supply of both enrichment fuel and enrichment air.

9. In an enrichment device as set forth in claim 8 wherein the certain condition is starting of the engine.

10. In an enrichment device as set forth in claim 9 wherein the enrichment air and fuel is supplied to the engine at a location downstream of the induction passage of the charge former.

11. In an enrichment device as set forth in claim 6 further including an idle discharge circuit for delivering idle fuel to the engine from the fuel bowl, the air conduit communicating the source of atmospheric air to the main discharge circuit also delivers fuel/air to the idle discharge circuit.

12. In an enrichment device as set forth in claim 11 wherein the fuel supplied by the enrichment device is drawn from a fuel bowl of the charge former.

13. In an enrichment device as set forth in claim 12 wherein a single valve controls the supply of both enrichment fuel and enrichment air.

14. In an enrichment device as set forth in claim 13 wherein the certain condition is starting of the engine.

15. In an enrichment device as set forth in claim 14 wherein the enrichment air and fuel is supplied to the engine at a location downstream of the induction passage of the charge former.

16. In a enrichment device for providing additional fuel to an engine for accommodating a certain condition, said engine comprising a charge former having a fuel bowl for containing a head of fuel, a discharge circuit comprised of a fuel conduit connecting said fuel bowl with a discharge port in an induction passage of said charge former, an air conduit communicating a source of atmospheric air with said fuel conduit for mixture with the fuel delivered through said discharge port, said enrichment device comprising means for delivering fuel and air to said engine in addition to that supplied by said charge former under certain conditions, the improvement comprising said additional air being supplied to said engine being drawn from said air conduit for reducing the pressure in said fuel conduit of said charge former for further increasing the fuel delivered to said engine in response to the certain condition, said fuel discharge circuit of said charge former comprises an idle circuit.

17. In an enrichment device as set forth in claim 16 wherein the fuel supplied by the enrichment device is drawn from a fuel bowl of the charge former.

18. In an enrichment device as set forth in claim 17 wherein a single valve controls the supply of both enrichment fuel and enrichment air.

19. In an enrichment device as set forth in claim 18 wherein the certain condition is starting of the engine.

20. In an enrichment device as set forth in claim 19 wherein the enrichment air and fuel is supplied to the engine at a location downstream of the induction passage of the charge former.

* * * * *